US009435465B1

(12) United States Patent
Kirschner

(10) Patent No.: US 9,435,465 B1
(45) Date of Patent: Sep. 6, 2016

(54) BRACKET FOR UTILITIES SUPPORT HARDWARE

(71) Applicant: AUTOMATIC FIRE CONTROL, INC., South El Monte, CA (US)

(72) Inventor: Kraig Kirschner, Corona, CA (US)

(73) Assignee: Automatic Fire Control, Inc., South El Monte, CA (US)

( * ) Notice: Subject to any disclaimer, the term of this patent is extended or adjusted under 35 U.S.C. 154(b) by 0 days.

(21) Appl. No.: 14/800,908

(22) Filed: Jul. 16, 2015

(51) Int. Cl.
*F16L 3/22* (2006.01)
*F16L 3/04* (2006.01)
*F16L 3/223* (2006.01)

(52) U.S. Cl.
CPC ..... *F16L 3/04* (2013.01); *F16L 3/2235* (2013.01)

(58) Field of Classification Search
CPC ..... F16L 3/04; F16L 3/2235; H02G 3/26; H02G 3/263; H02G 3/28; H02G 3/281; H02G 3/283; H02G 3/285; H02G 3/30; H02G 7/00
USPC ..... 52/220.1–220.8, 783.11–783.19; 248/58, 59, 221.11, 300, 611, 644, 248/200.1, 317, 342
See application file for complete search history.

(56) References Cited

U.S. PATENT DOCUMENTS

| | | | | |
|---|---|---|---|---|
| 2,161,782 | A * | 6/1939 | Flower | F16L 3/133 248/59 |
| 4,019,705 | A | 4/1977 | Habuda, Sr. et al. | |
| 4,197,687 | A * | 4/1980 | Benoit | E04B 5/04 52/262 |
| 4,335,557 | A * | 6/1982 | Morton | E04B 1/164 52/167.1 |
| 4,894,967 | A * | 1/1990 | Morton | E04B 7/00 228/182 |
| 6,058,668 | A * | 5/2000 | Herren | E04B 2/825 52/236.7 |
| 7,140,579 | B2 | 11/2006 | Kirschner | |
| 7,523,895 | B1 | 4/2009 | Kirschner | |
| 7,871,045 | B2 * | 1/2011 | Moore | F16M 13/02 248/188.1 |
| 8,074,412 | B1 * | 12/2011 | Gogan | E04B 2/7403 52/1 |
| 9,010,697 | B1 | 4/2015 | Kirschner | |
| 2007/0283643 | A1 * | 12/2007 | Surowiecki | E04B 2/7457 52/283 |
| 2011/0185656 | A1 * | 8/2011 | Klein | E04B 1/94 52/232 |

* cited by examiner

*Primary Examiner* — Christopher E Garft
(74) *Attorney, Agent, or Firm* — Karish & Bjorgum, PC

(57) ABSTRACT

A bracket for utilities hangers and sway braces suspended below a fluted deck includes a bracket plate having attachment holes therethrough spaced apart by the known pitch of the fluting on the deck. A mount is positioned in the plate. One or more flute keys extend perpendicular to the mounting plate and have two sides which are tapered away from the plate toward one another to fit within one or more flutes in the deck.

12 Claims, 3 Drawing Sheets

BRACKET FOR UTILITIES SUPPORT HARDWARE

BACKGROUND OF THE INVENTION

The field of the present invention is hardware for supporting utility conduit and pipe in a structure.

A wide variety of hardware has been employed for the support and retention of utility pipe and conduit in building applications. Examples of such hardware are illustrated in U.S. Pat. Nos. 9,010,697; 7,523,895; 7,140,579; 4,019,705, the disclosures of which are incorporated herein by reference in their entireties. In commercial structures, it is typical for utility conduits and pipes to be located in the plenum above the ceiling on each floor. Such conduits and pipes are hung and stabilized from an upper deck at the top of the plenum. Decks are often constructed of a corrugated metal plate with lightweight or normal weight concrete poured on top of the plate. Alternatively, removable forms with ridges and flutes may replace such corrugated metal plates. The flutes in the resulting deck under-surface reduce the amount and weight of concrete needed to generate the deck. Such decks with ridges and flutes are illustrated in FIGS. 10, 14 and 20.

Mounting brackets to support utility hangers and sway braces, collectively referred to herein as utilities supports, can be problematic with such fluted surfaces. An anchor for a bracket may be placed within a flute if the thickness of the concrete above the corrugated steel is sufficiently thick. In the flute, access may be difficult and the concrete thickness may not be known. Alternatively, anchors for a bracket may be placed on a ridge between flutes. There are appropriate limitations as to maximum offsets from the centerline of such a ridge for attaching utilities supports. One-eighth inch has been recommended. Care must be taken in any such mountings.

SUMMARY OF THE INVENTION

The present invention is directed to a bracket for utilities supports suspended below a fluted deck under-surface. The bracket includes a bracket plate having a length which is greater than the known pitch of the fluted deck. Attachment holes for attaching the plate to the underside of the deck are spaced apart by the known pitch of the fluted deck such that the attachment holes can be centered on adjacent ridges of the corrugation. A mount is provided for utilities attachment. One or more flute keys are located on the plate and extends perpendicular to the bracket plate. The sides of each flute key are sized to fit closely within the deck flute to place the attachment holes within tolerance on the associated ridges. Using such a key within a flute on the underside of a deck aligns the attachment holes centrally on adjacent ridges of the deck.

The cross-sectional contours of the deck flutes and ridges are frequently trapezoidal. In a further aspect of the present invention, the sides of such flute keys may be tapered away from the plate toward one another about a symmetrical centerline with the symmetrical centerline equally spaced from the attachment holes on the underside of a deck. With this geometry, each flute key is again positioned within a flute thereby aligning the attachment holes centrally on adjacent ridges of the deck. In structures, the large scale can make anomalies within tolerance significant on small components such as brackets. With a tapered flute key in slight incidental interference with the nominal tapered flute angle or width, the bracket plate can be drawn snug against the ridges of the deck by anchors to create a tight fit between the flute key and the flute structure. The flute key including tapered sides fitting closely within the flute of a deck resists lateral forces from a utilities support, such as induced by an earthquake. The flute key, rather than more vulnerable anchors, thus can bear such loads against the sides of the flute channel.

It is intended that the one or more flute keys be integrally formed or structurally rigid with the bracket plate. A rigid flute key provides added structure to the plate between the attachment holes, rigidifying the position of the mount. Further, the top of the flute key need not rise fully to reach the full depth of the flute. By having the flute key fit closely within the width of the known flute contour but not extend fully into the flute, the distal end of the flute key cannot interfere with the flute key engaging the sidewalls of the flute.

In another aspect of the present invention, a mounting bar may additionally be included with the plate which extends from the plate away from the overlying deck. The mounting bar may therefore have horizontal holes to receive fasteners retaining depending hangers and the like. Additional mounting holes may be provided as they need not be limited by the width of the associated flute. The orientation of the vertical mount at the bracket plate results in any fastener operating in tension. With horizontal holes in a depending mount, fasteners will operate in sheer to support depending hardware.

Accordingly, it is a principal object of the present invention to provide an improved bracket for use with corrugated decking. Other and further objects and advantages will appear hereinafter.

DETAILED DESCRIPTION OF THE PREFERRED EMBODIMENTS

Figure 1:
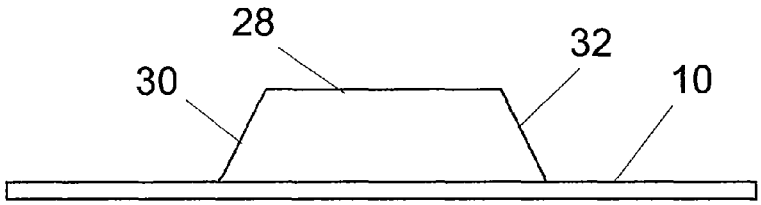
FIG. 1 is a side view of a bracket including a single flute key.
Figure 2:
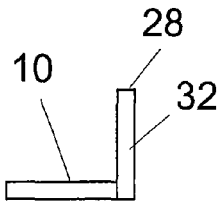
FIG. 2 is an end view of the bracket of FIG. 1.
Figure 3:
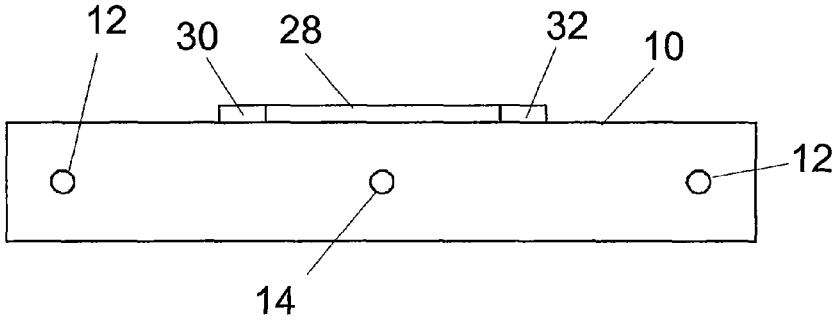
FIG. 3 is a plan view of the bracket of FIG. 1.

Turning in detail to the Figures, a first embodiment of the bracket is illustrated in FIGS. 1 through 3 and 10. The bracket includes a flat plate 10 having attachment holes 12 extending therethrough. These attachment holes 12 are symmetrically placed on the plate 10 with a vertical mount 14 conveniently located equidistant between the attachment holes 12. In the first embodiment, the mount 14 is shown to be a mounting hole 14 through the bracket plate 10.

The decks 16 to which the bracket plate 10 is contemplated to be attached are created by pouring concrete over a corrugated metal plate 18 or over removable forms to construct a fluted concrete layer 20. The corrugated metal plates 18 typically come in standard sizes with known uniform corrugations. Even with nonstandard removable forms which may be used in a large structure, a large quantity of brackets would likely be required and could be fabricated for the nonstandard but known pitches and flute contours on the under-side surfaces of the formed decks. As such, the pitch of the corrugations is known; and appropriate brackets can be selected or fabricated. The attachment holes 12 are spaced apart by that known pitch associated with the deck 16 defined by the corrugations or forms.

Figure 10:
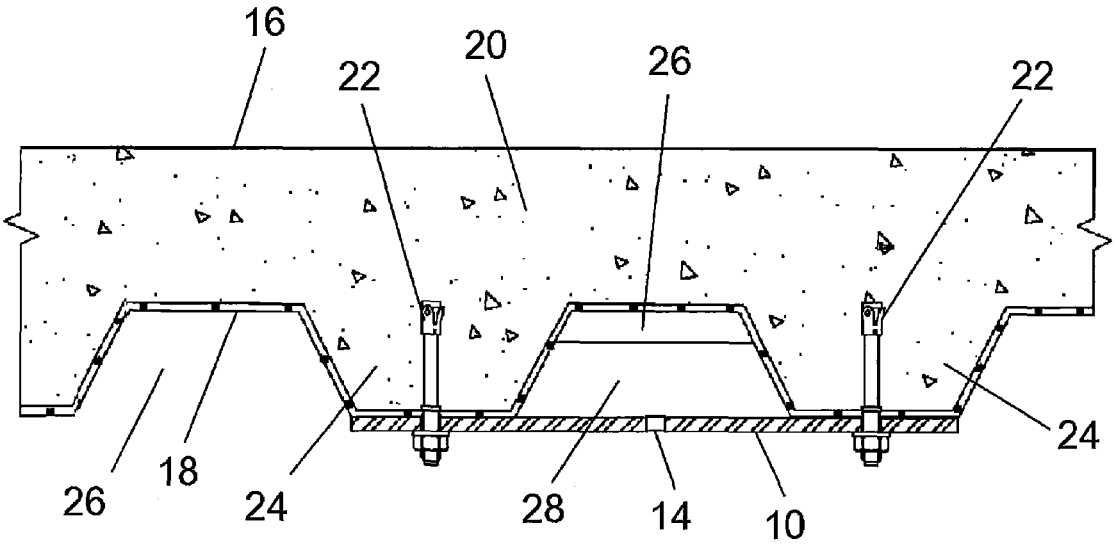
FIG. 10 is a cross-sectional view taken through the attachment holes of the bracket of FIG. 1, shown in position beneath a fluted deck.
Figure 11:
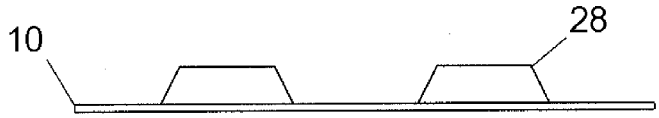
FIG. 11 is a side view of a bracket including two flute keys in series.
Figure 12:
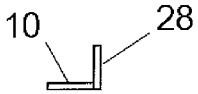
FIG. 12 is an end view of the bracket of FIG. 11.
Figure 13:
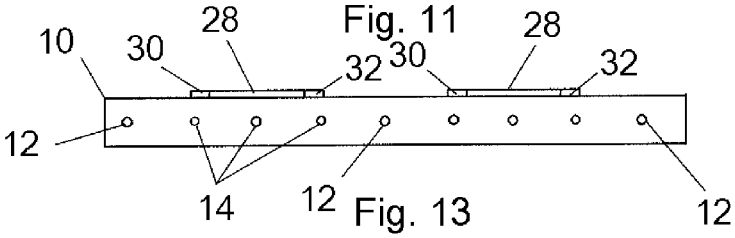
FIG. 13 is a plan view of the bracket of FIG. 11.
Figure 14:
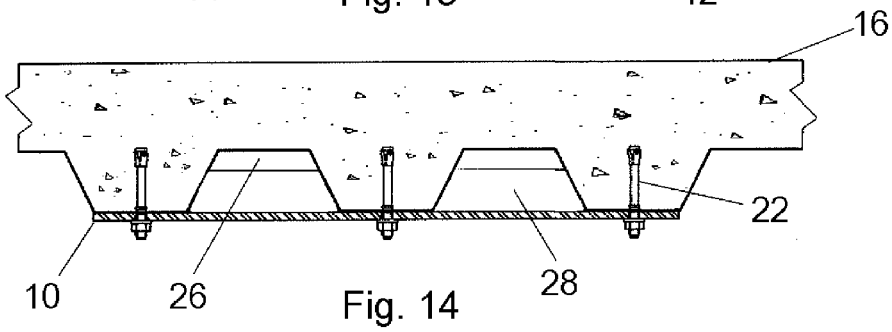
FIG. 14 is a cross-sectional view taken through the attachment holes of the bracket of FIG. 11, shown in position beneath a fluted deck.
Figure 15:
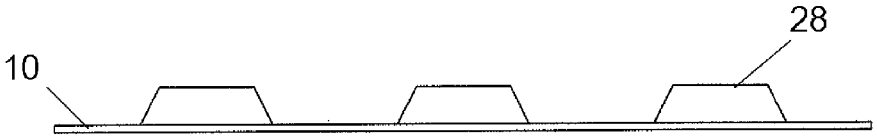
FIG. 15 is a side view of a bracket including three flute keys in series.
Figure 16:
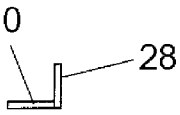
FIG. 16 is an end view of the bracket of FIG. 16.
Figure 17:
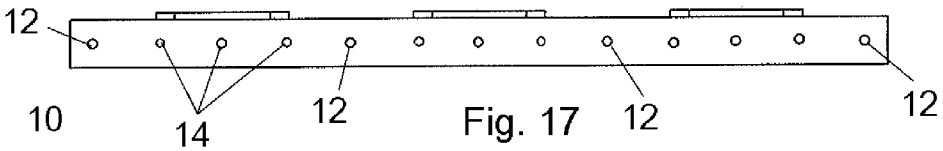
FIG. 17 is a plan view of the bracket of FIG. 19.
Figure 18:
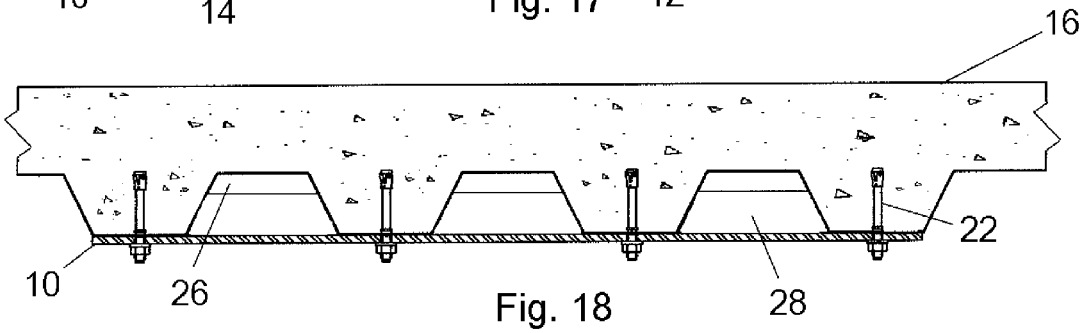
FIG. 18 is a cross-sectional view taken through the attachment holes of the bracket of FIG. 16, shown in position beneath a fluted deck.

As can be seen in FIG. 10, anchors 22, extending through the attachment holes 12, are spaced one pitch apart on the fluted deck 16 and located in the center of each ridge 24. In this arrangement, the plate 10 spans the deck flute 26 between the ridges 24. The mount 14, located equidistant between the attachment holes 12, is centered below the flute 26 in this embodiment. Symmetry can avoid unbalanced moments if such is at issue. The plate 10 is longer than the known pitch to provide structure around the attachment holes 12 to carry the load suspended below the plate 10 in turn retained by the anchors 22.

A flute key 28 is on the bracket plate 10. This flute key 28 may be integrally formed with the plate 10 or otherwise associated therewith such as through welding. The flute key 28 is conveniently located along the edge of the bracket plate 10 and may extend perpendicular thereto. The flute key 28 includes two sides 30, 32 which are tapered away from the plate 10 toward one another. The sides 30, 32 are spaced apart by less than the known pitch and angled such that they fit closely in the width contour within the known flute 26 when the bracket is positioned against the underside of the deck 16. The flute key 28 is shorter than the full depth of the known flute 26 to insure that the distal end of the flute key 28 does not interfere with the positioning of the bracket.

It is preferred that the sides 30, 32 of the flute key 28 fit snuggly within the width contour of the flute 26 when the plate 10 is drawn tight against the metal plate 18 or concrete so that the sides 30, 32 can sustain lateral forces imposed on the bracket by hardware hung therefrom. The flute key 28 may be thought of as having a symmetrical centerline extending vertically in the plane of the key 28 with the sides tapering symmetrically. Further, the flute key 28 is arranged such that the symmetrical centerline is equally spaced from the attachment holes 12. The flute key 28 then positions the bracket plate 10 so that the attachment holes 12 are properly positioned and centered on the ridges 24 for attachment by anchors 22. The presence of the flute key 28 as attached to the bracket plate 10 further strengthens the bracket plate 10 against bending under load between the anchors 22.

Figure 5:
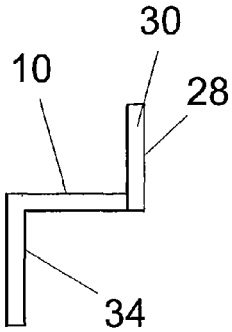
FIG. 5 is an end view of the bracket of FIG. 4.
Figure 4:
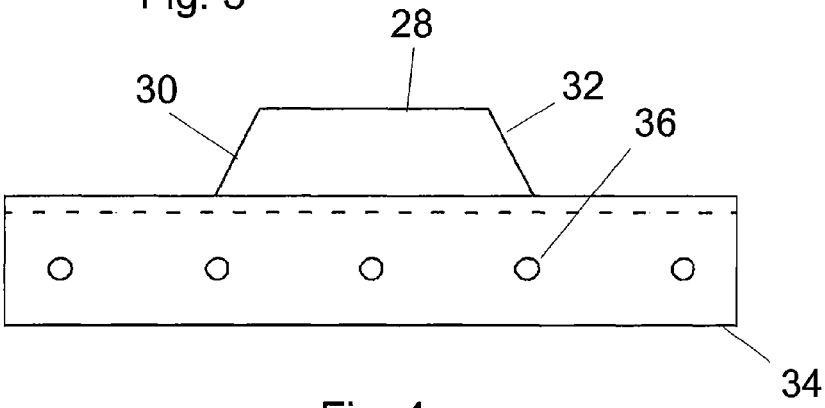
FIG. 4 is a front view of the bracket of FIG. 1 further including a depending mount.
Figure 6:
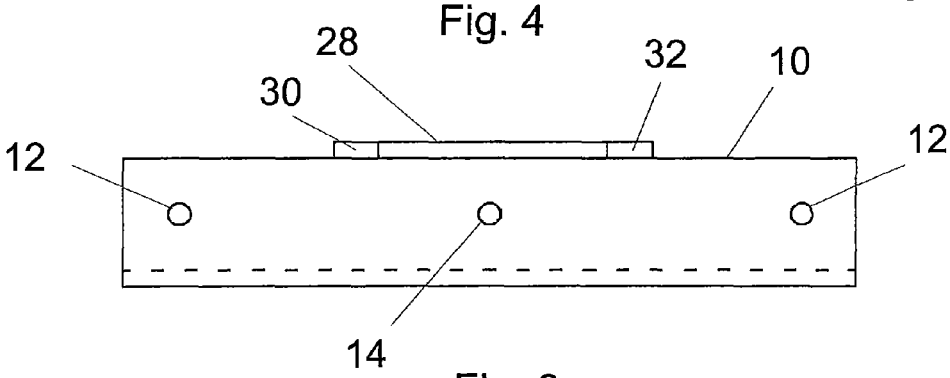
FIG. 6 is a plan view of the bracket of FIG. 4.

A second embodiment of the bracket is illustrated in FIGS. 4 through 6. This second embodiment is shown to be identical to the first embodiment but for the addition of a mounting bar 34 on the bracket plate 10. The mounting bar 34 extends perpendicular to the bracket plate 10 in a direction opposite to that of the flute key 28. The mounting bar 34 also extends from an edge of the plate 10 and may be integrally formed or rigidly attached. The mounting bar 34 includes horizontal mounting holes 36 therethrough to provide alternative mounting orientation to the bracket.

Figure 7:
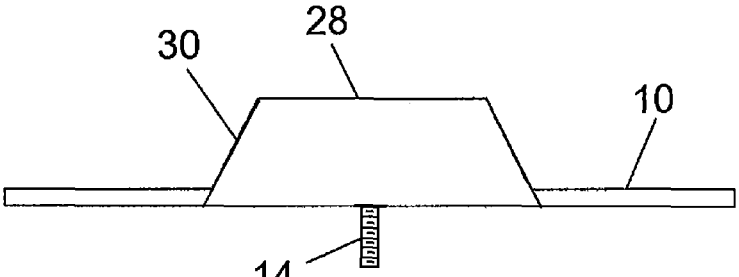
FIG. 7 is a front view of a bracket including two flute keys in parallel.
Figure 8:
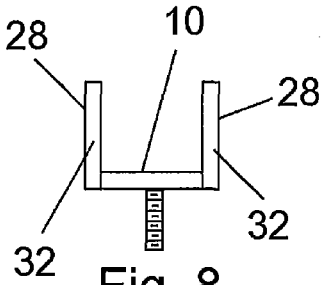
FIG. 8 is an end view of the bracket of FIG. 7.
Figure 9:
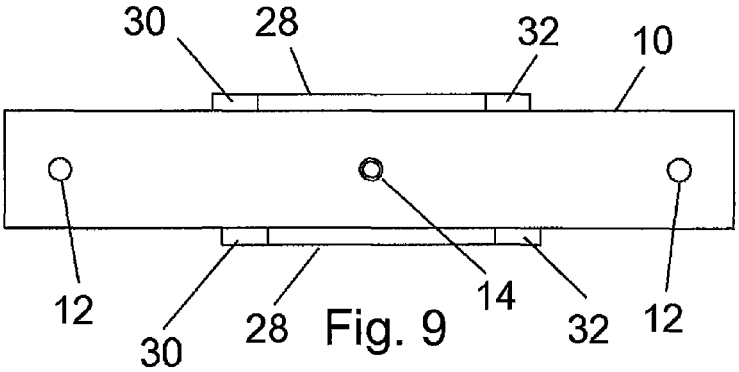
FIG. 9 is a plan view of the bracket of FIG. 7.

A further embodiment is illustrated in FIGS. 7 through 9. This bracket includes the elements of the first embodiment and additionally has a second flute key 28 adjacent to the first flute key 28 at the opposed edge of the bracket plate 10. The bracket arrangement with two flute keys 28 spaced apart and adjacent to be engaged with a single flute 26 provides additional structure to resist non-axial loads that would otherwise be sustained by the anchors 22 in earthquakes and the like. Additionally, the two flute keys 28, both being spaced laterally from the anchors 22, provide a resistance moment against distortion of the bracket plate 10 from forces in either direction aligned with the flute 26. As the second flute key 28 may deny access to the upper surface of the plate 10 when positioned under a deck, a fastener may be permanently affixed as the mount 14 on the underside of the plate 10 or positioned through a mounting hole before attachment of the plate 10 to the deck. Alternatively, the mount 14 may be tapped to receive a threaded stud associate with or to be associated with a utilities support.

FIGS. 11 through 14 disclose another embodiment employing the same reference numbers as the first two embodiments for similar elements. In this third embodiment, there are two flute keys 28 with sides 30 and 32 associated with a plate 10. The flute keys 28 are shown to lie in a plane and displaced one pitch of the fluted deck 16 from one another to fit within two adjacent flutes 26. The plate 10 now has a length greater than two known pitches of the fluted deck 16, again to provide structure for attachment holes 12. As the plate 10 spans three ridges 24, there are three attachment holes 12 to receive three anchors 22. Additional mounting holes 14 through the plate 10 afford further mounts by this expanded bracket, which are shown located between adjacent pairs of attachment holes 12.

FIGS. 15 through 20 provide the disclosure of an even wider bracket spanning four ridges 24 with four corresponding mounting holes 14 and anchors 22. Additional mounting holes 12 can be provided to give additional degrees of alignment to the mount. The mount defined by the depending mounting bar 34 of the embodiment of FIGS. 4 through 6 is also contemplated to be combined with the embodiments of FIGS. 7 through 9 and 11 through 20.

Thus, an improved bracket for utilities hangers depending from fluted decks is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A bracket for a utilities support suspended below a fluted deck of a known pitch and flute contour, comprising a plate including a length greater than the known pitch, attachment holes therethrough spaced apart by the known pitch and a mount;

a first flute key on the plate including two first sides tapered away from the plate toward one another, in interfering fit within a width of the known flute contour, being attached between the two first sides to the plate and extending perpendicular to the plate where attached, the first flute key further including a symmetrical centerline extending perpendicular to the plate between the two first sides, the symmetrical centerline being equally spaced from the attachment holes, the fluted deck having flutes of a known depth, the first flute key extending from the plate by less than the known depth.

2. The bracket of claim 1, the mount being a mounting hole through the plate.

3. The bracket of claim 1, the first flute key extending perpendicular to the plate in a first direction, the mount extending perpendicular to the plate in a second direction and including at least one mounting hole extending through the mount perpendicular to the first flute key.

4. The bracket of claim 1 further comprising a second flute key on the plate including two second sides in interfering fit within the width of the known flute contour, the flute keys being adjacent at opposite edges of the plate.

5. The bracket of claim 1 further comprising a second flute key displaced one known pitch from the first flute key on the plate and including two second sides closely fitting within the width of the known flute contour, the plate being longer than twice the known pitch.

6. The bracket of claim 5, the first flute key and the second flute key lying in a common plane.

7. The bracket of claim 1, the mount being centered on the plate between adjacent attachment holes.

8. The bracket of claim 1 further comprising a second flute key displaced one known pitch from the first flute key on the plate and including two second sides tapered away from the plate toward one another, closely fitting within the width of the known flute contour, being attached between the two first sides to the plate and extending perpendicular to the plate where attached and a second symmetrical centerline extending perpendicular to the plate between the two second sides, the two second sides being spaced from one another at the plate by less than the known pitch, the plate being longer than twice the known pitch.

9. A bracket for a utilities support suspended below a fluted deck of a known pitch and flute contour, comprising a plate including a length greater than two of the known pitch, three attachment holes therethrough spaced apart in series by the known pitch and a mount;

two flute keys on the plate displaced one known pitch from one another, each flute key including two sides tapered away from the plate toward one another, in interfering fit within a width of the known flute contour, being attached between the two first sides to the plate and extending perpendicular to the plate where attached and a symmetrical centerline extending perpendicular to the plate between the two sides, the two sides being spaced from one another at the plate by less than the known pitch, the symmetrical centerline being equally spaced between two adjacent attachment holes, the fluted deck having flutes of a known depth, the flute keys extending from the plate by less than the known depth.

10. The bracket of claim 9, the flute keys lying in a common plane.

11. The bracket of claim 9, the mount being a mounting hole through the plate.

12. The bracket of claim 9, the first flute key extending perpendicular to the plate in a first direction, the mount extending perpendicular to the plate in a second direction and including at least one mounting hole extending through the mount perpendicular to the first flute key.

* * * * *